US009205973B2

(12) United States Patent
Decea et al.

(10) Patent No.: US 9,205,973 B2
(45) Date of Patent: Dec. 8, 2015

(54) AEROSOL ACTUATOR WITH REMOVABLE HANDLE AND DISABLING DEVICE

(71) Applicant: TECHNIMA, Nersac (FR)

(72) Inventors: Cedrik Decea, Cognac (FR); Claude Bernard Michelot, Nersac (FR)

(73) Assignee: TECHNIMA, Nersac (FR)

( * ) Notice: Subject to any disclaimer, the term of this patent is extended or adjusted under 35 U.S.C. 154(b) by 15 days.

(21) Appl. No.: 14/091,583

(22) Filed: Nov. 27, 2013

(65) Prior Publication Data

US 2014/0183228 A1 Jul. 3, 2014

(30) Foreign Application Priority Data

Nov. 27, 2012 (FR) ..... 12 61294

(51) Int. Cl.
*B67B 1/00* (2006.01)
*B65D 83/20* (2006.01)
*B65D 83/22* (2006.01)

(52) U.S. Cl.
CPC ..... *B65D 83/205* (2013.01); *B65D 83/202* (2013.01); *B65D 83/222* (2013.01); *B65D 83/206* (2013.01)

(58) Field of Classification Search
CPC .. B65D 83/205; B65D 83/206; B65D 83/207; B65D 83/201; B65D 83/202; B65D 83/22; B65D 83/752; B65D 83/222
USPC ..... 222/153.11–154.14, 402.11, 402.13, 222/402.15, 153.11–153.14, 153.1
See application file for complete search history.

(56) References Cited

U.S. PATENT DOCUMENTS

| | | | | |
|---|---|---|---|---|
| 6,029,862 | A | 2/2000 | Jones | |
| 6,523,722 | B1 * | 2/2003 | Clark et al. | 222/153.14 |
| 7,530,476 | B2 * | 5/2009 | Downey et al. | 222/153.11 |
| 7,686,193 | B1 | 3/2010 | Gervais et al. | |
| 7,861,894 | B2 * | 1/2011 | Walters et al. | 222/153.11 |
| 8,276,832 | B2 * | 10/2012 | Nelson et al. | 239/391 |
| 8,418,892 | B2 * | 4/2013 | Geier | 222/402.11 |
| 2005/0184093 | A1 | 8/2005 | Brunerie et al. | |
| 2007/0235474 | A1 | 10/2007 | Downey et al. | |
| 2008/0179347 | A1 | 7/2008 | Yerby et al. | |
| 2009/0294615 | A1 | 12/2009 | Huang | |
| 2010/0051652 | A1 | 3/2010 | Becker | |

FOREIGN PATENT DOCUMENTS

| | | | |
|---|---|---|---|
| DE | 202009001448 | U1 | 9/2009 |
| FR | 2865463 | A1 | 7/2005 |
| WO | 9611151 | A1 | 4/1996 |

* cited by examiner

*Primary Examiner* — Lien Ngo
(74) *Attorney, Agent, or Firm* — Im IP Law PLLC; C. Andrew Im

(57) ABSTRACT

A diffuser cap for an aerosol actuator comprises a vessel and a valve mounted on the vessel utilizing a dome. The diffuser cap is provided with an operating pushbutton of the valve cooperating with an outlet tube from the valve. The pushbutton of the diffuser cap is provided with a channel and an aerosol diffusion outlet. The diffuser cap comprises a base configured to snap onto a crimped region of the dome and a protective unit surrounding the pushbutton. The pushbutton and the protective unit of the pushbutton are mounted in a rotary manner on the base. The diffuser cap comprises a disabling device for disabling the operation of the pushbutton operated by a relative movement of the protective unit in relation to the base.

21 Claims, 7 Drawing Sheets

AEROSOL ACTUATOR WITH REMOVABLE HANDLE AND DISABLING DEVICE

RELATED APPLICATIONS

This application claims priority from French Patent Application No. 12 61294 filed Nov. 27, 2012, which is incorporated herein by reference in its entirety.

BACKGROUND TO THE INVENTION

1. Field of the Invention

The present invention relates to an aerosol actuator with a removable handle and an operating prevention device.

An actuator of this kind is particularly adapted to paint spraying with the application of a propellant. The aerosol actuators comprise a housing with a pressure vessel in the form of a cylindrical body and a valve. A number of housings have a diffuser cap to operate the valve, which makes the actuator more reliable and more ergonomic. For these housings, a cap provided with a diffuser button, possibly with a spray nozzle, is mounted on the vessel.

For applications which require the valve actuator button to be pressed for a prolonged period or repeatedly, for example for professional uses of aerosol paint housings, it is known in the art for the housings to be fitted with handles equipped with a trigger operating the valve.

For applications which require safety, there are devices adapted to prevent operation of the valve.

2. Technical Background

Document FR2865463 A1 relates to an aerosol housing comprising a diffuser cap provided with a base snapping onto a crimped section of a dome of the housing, with a protective unit for an operating button surrounding said button, wherein the base and the pushbutton comprise additional rotary means locking the pushbutton in a position which prevents the valve from being operated.

Moreover, documents U.S. Pat. No. 6,029,862, US 2009/0294615 A1, US 2010/0051652 A1, DE 20 2009001 448 U1 envisage aerosol housings with a handle.

These devices from the prior art are not actuators with a cap and removable handle which allow the diffuser and the handle to be separated, in order to preserve the functions of an actuator with a diffuser cap and no handle.

Document WO 96/11151 A1 relates to a handle device fixed to an aerosol actuator diffuser cap which is only fixed to the top of the actuator.

OBJECT AND SUMMARY OF THE INVENTION

The present invention firstly proposes a sturdy cap comprising a base and a component attached to the base comprising a protective unit for a pushbutton.

It moreover envisages an aerosol actuator with diffuser cap and removable handle assembly, the aerosol actuator comprising a cap provided with a device for preventing operation of a housing valve operating button accessible at handle level.

To achieve this, the present invention proposes a diffuser cap for an aerosol actuator comprising a vessel and a valve mounted on the vessel by means of a dome, the diffuser cap being provided with an operating pushbutton for the valve cooperating with an outlet tube from the valve, the pushbutton of the diffuser cap being provided with a channel and an aerosol diffusion outlet, wherein the diffuser cap comprises a base adapted to snap onto a crimped region of the dome and a protective unit for the pushbutton surrounding said pushbutton, the pushbutton and the protective unit of the pushbutton being mounted in a rotary manner on the base and wherein the diffuser cap comprises means of preventing operation of the button operated by a relative movement of the protective unit in relation to the base, wherein the protective unit and the base comprise first and second snap-on means adapted to cooperate in order to hook the protective unit onto the base, the first means being realized on the base and supported by an inside wall of an annular groove limited by said inside wall and by an outside wall, the second means being realized on an inner face of an annular skirt of the protective unit inserted between the inside wall and the outside wall of the annular groove, the annular groove having a width adapted to resist the unsnapping of the skirt by pulling.

According to a preferred embodiment, the protective unit and button assembly is realized as a single part, the button being connected to the protective unit by a flexible tongue.

The operating prevention means are advantageously activated and deactivated by rotating the protective unit.

According to a particular embodiment, the operating prevention means comprise a shoulder and a finger, the finger being adapted to bear against the shoulder in said locking position of the pushbutton.

The protective unit and the base advantageously comprise means of stopping rotation of the protective unit by defining a locking position and a release position of the pushbutton allowing the valve to be operated by the pushbutton and comprise reference means adapted to allow the locked or unlocked state of the pushbutton to be viewed.

The protective unit and the base may, in addition, comprise a ratchet device suitable for realizing a friction point and an auditory signal during movement between said locking position and the release position of the button.

The protective unit advantageously forms an overcap fixed to the base and is provided with a flush-fitting profile in a drip molding in the base. This profile has the particular advantage of increasing the rigidity of the cap assembly on the base, improving the centering thereof and preventing the protective unit from being skewed, which could possibly allow it to be unclipped.

According to a particular embodiment, the channel opens out into a receiving chamber of a removable nozzle provided with the diffusion outlet of the aerosol and of a positioning lug in the pushbutton.

The invention applies to an aerosol actuator comprising a vessel, a valve fitted to the vessel by means of a dome and a diffuser cap, wherein the base is mounted in a rotating manner on the vessel and snaps onto a crimped region of the dome on the vessel to cover the upper portion of the housing, which allows the cap to be correctly centered.

The invention further relates to an aerosol actuator and removable handle assembly, wherein the handle comprises a trigger, a pressing mechanism on the pushbutton linked to the trigger and an overcap concealing at least one operating portion of the pushbutton, the overcap comprising indentations adapted such that the operating prevention means of the valve activated and deactivated by rotating the protective unit of the button remains accessible.

The overcap preferably comprises a cutout adapted to leave the diffusion nozzle visible, said cutout being surrounded by a skirt guarding against spray coming from the nozzle.

The handle advantageously comprises retaining means on the vessel in the form of a ring encircling the vessel.

According to an advantageous embodiment, the handle comprises a hooking means fixed beneath the vessel opposite the diffuser cap.

According to a first embodiment, the hooking means is a hook.

The hook may particularly hook into a hollow beneath the housing.

The handle may particularly comprise a fixed device extending the handle from the side opposite the diffuser provided with a second retaining and vessel centering ring, retaining legs connected by an annular spring component located about the lower end of the vessel and supporting tabs for disengaging the hook by pressing with the fingers at the level of the tabs on the annular spring component.

According to an alternative embodiment, the hooking means is supported by a shaft mounted in a sliding manner relative to the body of the handle.

The handle is advantageously provided with means of stopping the shaft according to a plurality of positions, such that the handle is adapted to housings of different heights.

The shaft is advantageously received in a sleeve bearing against the side of the vessel.

According to a particular embodiment, the hooking means is realized in the form of a base.

The handle advantageously comprises means of hooking a scraping tool extending from an upper face of the overcap.

In order to increase actuator safety, the handle may particularly include a trigger locking clip.

BRIEF DESCRIPTION OF THE FIGURES

Other characteristics and advantages of the invention will become clear on reading the following description of a non-limiting exemplary embodiment of the invention referred to in the drawings which show.

DETAILED DESCRIPTION OF AN EXEMPLARY EMBODIMENT OF THE INVENTION

Figure 1:
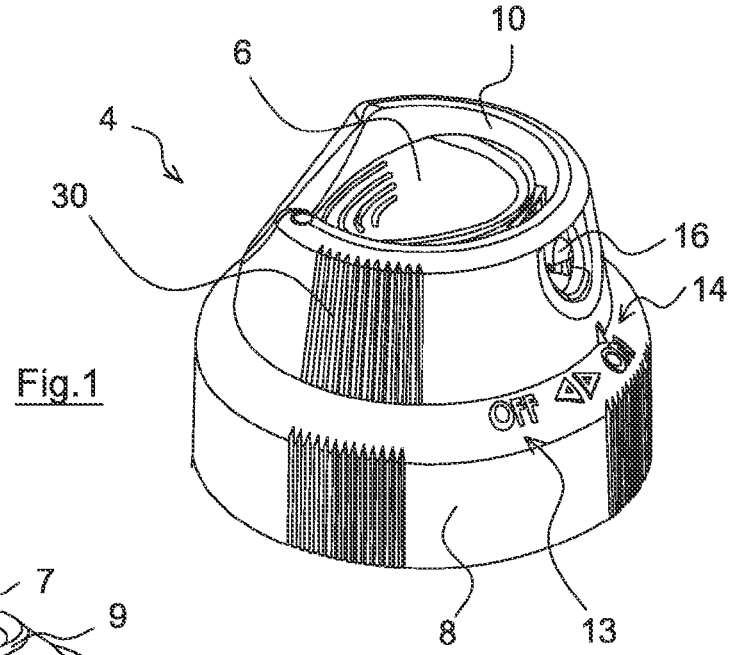
in FIG. 1: a perspective view of a diffuser cap according to an aspect of the invention.

The present invention applies to aerosol actuators comprising a housing such as that represented in FIG. 1.

A housing of this kind comprises a tubular vessel 1 provided with an upper end equipped with a valve 2 disposed at the top of a crimped dome 3 on the housing 1.

The valve is fixed in the dome by means of a cup 31 and comprises a product output tube 7 which is kept under pressure in the vessel 1 of the housing.

Figure 2:
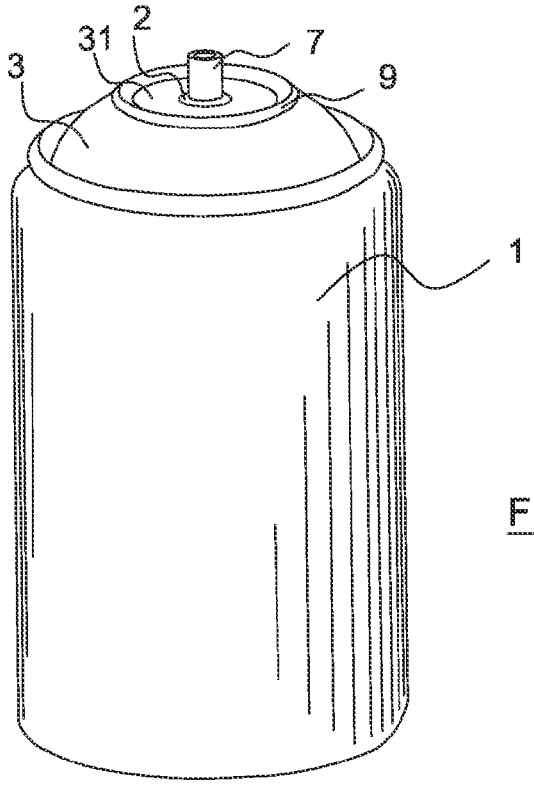
in FIG. 2: a perspective view of three-quarters of an example of an aerosol actuator to which the invention applies.

At the top of the housing, the aerosol actuator comprises a diffuser cap 4, an example of which is shown in FIG. 2.

The diffuser cap 4 is provided with a pushbutton 6 operating the valve 2.

Figure 3:
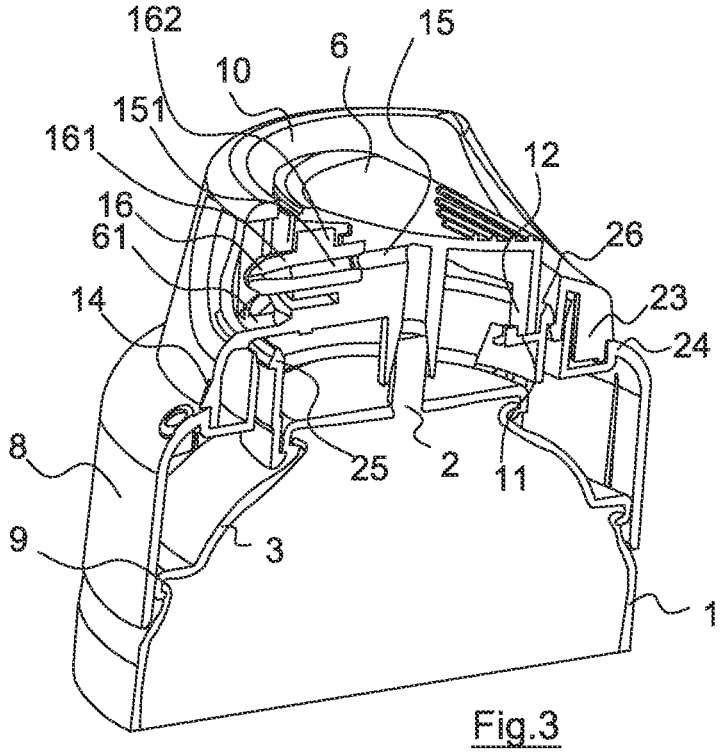
in FIG. 3: a perspective view as a vertical section through the diffuser cap in FIG. 1.

As depicted in the sectional view in FIG. 3, the pushbutton is provided with a channel 15 and an aerosol diffusion outlet 16 in the form of a diffusion nozzle 161. The channel 15 comprises a vertical bottom portion which widens out to connect to the outlet tube 7 of the valve 2.

Figure 10:
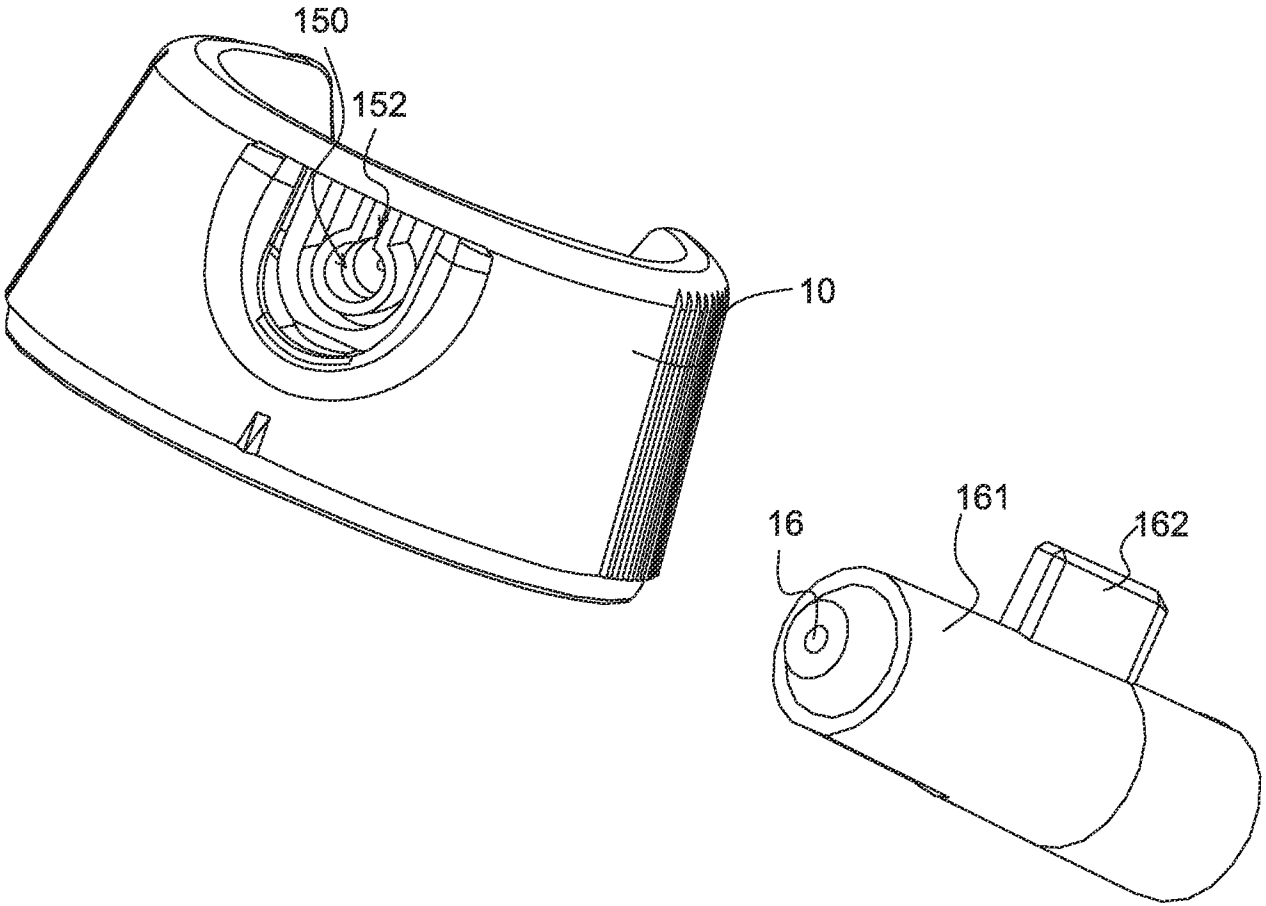
in FIG. 10: a three-quarters front view of the pushbutton and protective unit assembly with the nozzle removed and a perspective view of a nozzle mounted in this assembly.

According to FIG. 10, the channel 15 opens out into a receiving chamber 150 of a removable nozzle 161 provided with a positioning lug 162 in the pushbutton.

In FIG. 10 the nozzle is represented in a widened-out form relative to the chamber 150.

The nozzle 161 is forcibly inserted into the chamber 150, the lug 161 being received in a groove 152 on one side of the chamber 150.

Returning to FIG. 3, the nozzle comprises a channel 151 extending from the channel 15.

The channel 151 ends with the outlet 16 which is going to have a form adapted to a particular nozzle function use. In particular, nozzles may be provided which produce a conical jet, a flat jet or other.

Returning to FIG. 2, the diffuser cap 4 comprises a base 8 which covers the housing dome.

Returning to FIG. 3, the base 8 snaps onto a crimped section 9 of the dome 3 on the vessel 1 to cover the upper portion of the housing.

This hooking or snapping of the base onto the housing located close to the center of the dome has the particular advantage of reducing the sequence of dimensions between the channel 15 of the pushbutton and the tube 7 of the valve, making the cap more resistant to a press of the button and also allowing the base to perfectly cover the top of the housing on account of it not comprising peripheral hooking means.

The diffuser cap 4 moreover comprises a protective unit 10 of the pushbutton 6 surrounding the pushbutton.

The protective unit has the particular function of preventing ill-timed releasing during impact or avoiding accidental pressing of the pushbutton.

Moreover, the protective unit is designed to avoid dismantling, so as to protect the valve and preserve the integrity of the cap. To achieve this, the protective unit and base comprise first and second snap-on means 25, 26.

According to the example, the first means 25 are realized on the base in an annular groove limited by an inside wall 27 and an outside wall 28.

The first means are realized in the form of sloping surfaces supported by the inside wall 27 of the annular groove and ending with a bevel, so as to form in section a kind of ramp ending with a stop wall.

The second means 26 are realized on an inner face of an annular skirt 29 of the protective unit inserted between the inside wall 27 and the outside wall 28 of the annular groove.

The second means in cross section also comprise a ramp profile and a stop wall, such that it is possible to snap the protective unit onto the base by sliding the ramps one onto the other, but that their separation is made difficult by pressing stop walls one against the other.

Moreover, in order to prevent the protective unit from being dismantled by wrenching, the annular groove has a width adapted to resist the unsnapping of the skirt by pulling, twisting of the skirt material being made difficult by the presence of the outside wall 28 of the groove, while twisting of the inside wall of the groove is made difficult by the first means being realized on the outside of the wall 27.

It is worth noting that if an attempt is made to wrench off by hand, this effective snap-on device still allows the protective unit to be rotated in relation to the base.

In order to perfect the design of the protective unit to prevent ill-timed disassembly of the pushbutton, the protective unit 10 forms an overcap which is fixed on the base and is provided with a flush-fitting profile 23 in a drip molding 24 in the base 8. Apart from the advantages seen above in relation to increasing the assembly rigidity of the cap assembly on the base, improving the centering thereof and preventing the protective unit from being skewed, which could possibly allow it to be unclipped, this assembly resists the insertion of a tool that could lever beneath the protective unit. Likewise, apart from the fact that it is esthetically pleasing, this assembly prevents the protective unit and the base from becoming separated in the event of an impact on the protective unit.

Figure 4:
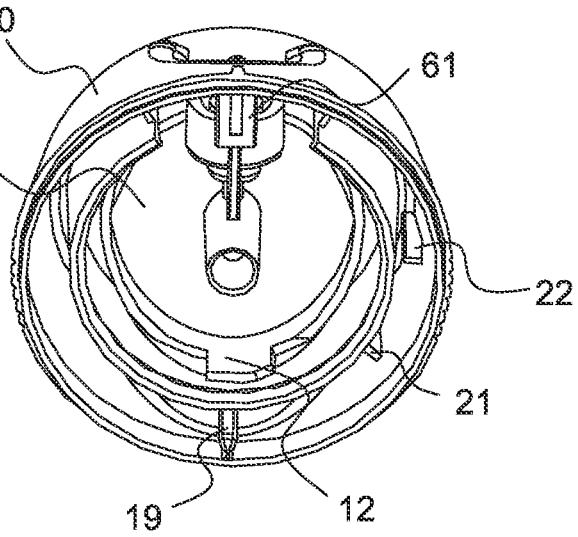
in FIG. 4: a perspective view from below of a pushbutton and protective unit assembly according to an aspect of the invention.

According to FIG. 4, the protective unit and the button are realized as a single part, the button being connected to the protective unit by a flexible tongue 61 situated below the outlet 16 of the diffuser pushbutton.

The outlet 16 beneath the pressing surface of the pushbutton is itself disposed in an aperture made in the wall of the protective unit.

The protective unit comprises an upper stop in the form of a crescent which only leaves a rear operating portion of the pushbutton accessible.

According to an aspect of the invention, the base 8 and the pushbutton include complementary means 11, 12 of preventing the pushbutton 6 from being operated.

These complementary means are adapted to adopt a locking position of the pushbutton, which prevents the valve 2 from being operated by the pushbutton.

Figure 6:
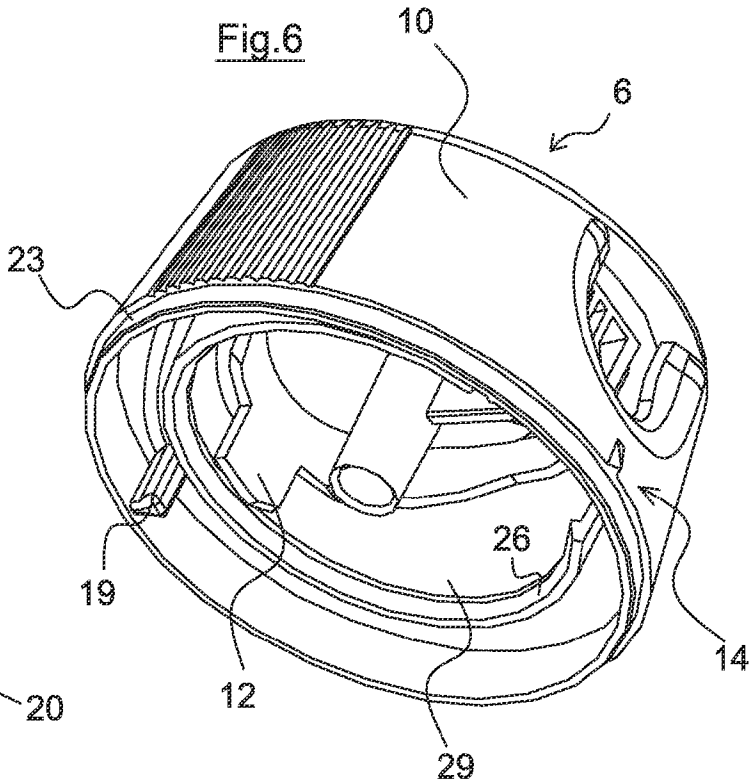
in FIG. 6: a perspective view from below of the pushbutton and protective unit assembly in FIG. 4.
Figure 5:
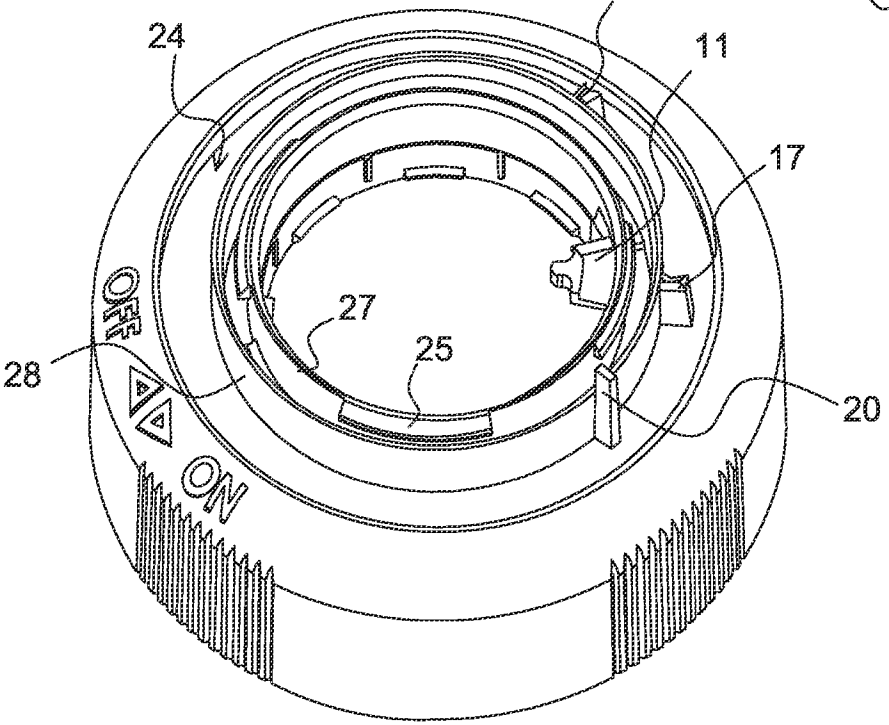
in FIG. 5: a perspective view from above of a base of a diffuser cap base in the invention.

According to the example shown particularly in FIG. 3, in a locking position and in the views of the base 8 in FIG. 5 and of the protective unit/pushbutton assembly in FIG. 6, respectively, the operating prevention means comprise a shoulder 11 realized in the form of a platform in a central circular opening in the base 8 and a finger 12 extending vertically beneath a lower section of the pushbutton 6, the finger being adapted to press against the shoulder in said locking position of the pushbutton.

Hence, a rotation of the protective unit/pushbutton assembly on the base makes it possible to move from a position wherein the finger is staggered in an angular manner relative to the shoulder 11, making it possible to operate the pushbutton and open the valve to diffuse the product, to a position wherein the finger rests on the shoulder, locking the pushbutton and prevents the valve 2 from opening.

It should be noted that the platform is preceded by a ramp which lifts the finger onto the platform, so as to lift the pushbutton slightly into the operating prevention position.

To make the positioning more precise when rotating the protective unit and pushbutton assembly between the two positions, the example shown comprises rotational stopping means 17, 18, 19 of the protective unit.

These means represented in FIGS. 5 and 6 comprising two angular catches 17, 18 and a shaft 19 supported against one or other of the catches define a locking position and a release position of the pushbutton allowing the valve to be operated by the pushbutton.

In line with the catches 17, 18, the protective unit 10 and the base 8 comprise reference means 13, 14 adapted to allow the locked and unlocked state of the pushbutton 6 to be viewed.

In order to make the movement from the release position of the button to the locking position of the button, and vice versa, audible and/or touchable, the protective unit 10 and the base 8 comprise a snap device 20, 21, 22 adapted to realize a friction point and an auditory signal during movement between said locking position and the release position of the button. This device comprises a spring tongue 20 and two friction points 21, 22.

Figure 7:
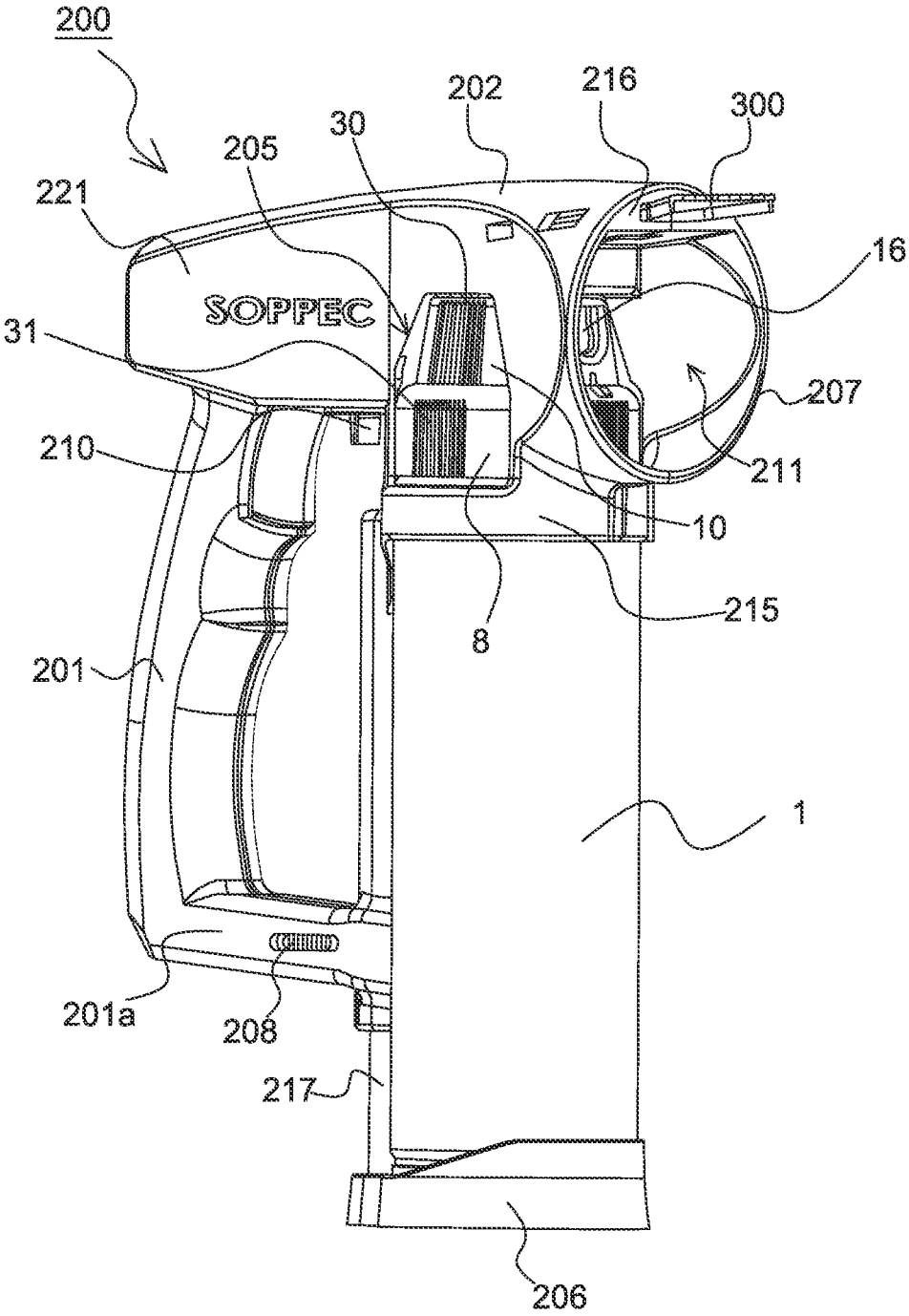
in FIG. 7: a perspective side view of a handle according to the invention.
Figure 8:
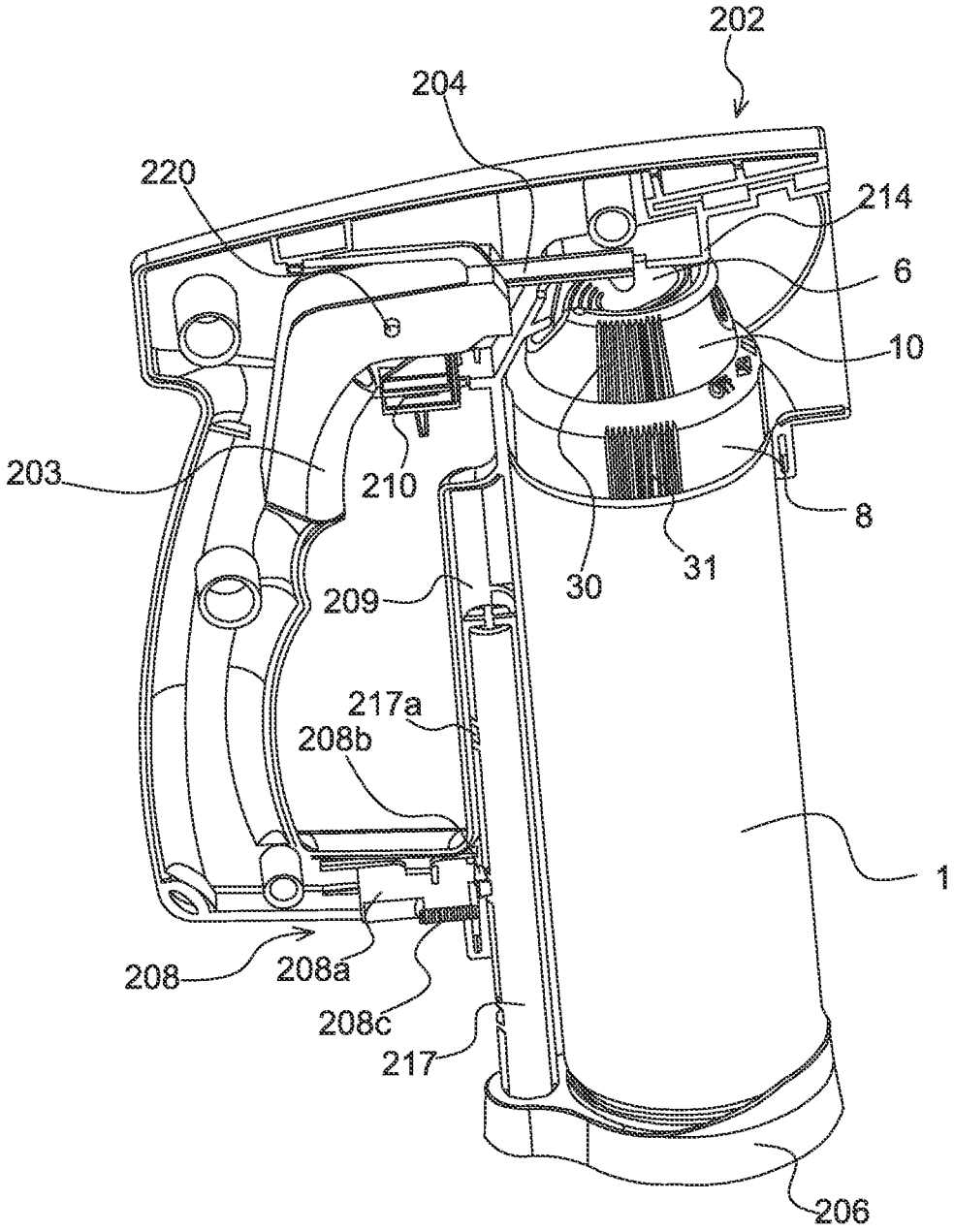
in FIG. 8: a perspective view of the handle in FIG. 7 open and mounted on an aerosol actuator.

The invention further relates to an aerosol actuator 100 and removable handle 200 assembly, as represented in FIGS. 7 and 8, which comprises a handle body 201 forming a substantially vertical gripping means attached to a chamber portion 221 of a substantially horizontal operating mechanism.

The handle shown only in FIG. 7 comprises an overcap 202 which covers the top of the cap and is adapted to conceal at least an operating portion of the pushbutton 6.

The overcap 202 comprises indentations 205 on its sides, said indentations being adapted to leave the valve operating prevention means accessible, which means are activated and deactivated by rotating the protective unit.

In fact, the lateral indentations enable the operator to gain access to the sides of the protective unit, said sides being provided with ridges 30 which allow the protective unit and button assembly to be easily turned, in order to move from the position allowing the valve to be operated to the position preventing it.

Likewise, the base comprises ridges 31 accessible through the indentations, which makes it possible to hold the base while the operator turns the protective unit.

The front of the overcap 202 comprises a cutout 211 adapted to leave the diffusion nozzle 16 visible and allow the outlet of the product to be atomized.

The cutout is surrounded by a skirt 207 guarding against spray coming from the nozzle, for example when there is a wind that diffuses the atomization mist.

This skirt extends towards the front beyond the diffusion nozzle.

On the top of the skirt, extending from an upper face of the overcap 202, the handle comprises means 216 of hooking a scraper tool 300 that is thereby positioned ready for use.

Beneath the overcap, the handle comprises retaining means 215 on the vessel 1 in the form of a ring enclosing the vessel. This ring is positioned beneath the base.

Likewise, in order to keep the handle on the aerosol actuator, the handle according to the example depicted in FIG. 8 comprises a base 206 fixed beneath the vessel opposite the diffuser cap.

According to this figure, in which the handle is represented in section according to a vertical plane, the handle comprises a shoulder 214 in the upper portion, said shoulder resting on the upper stop of the protective unit 10. The aerosol actuator is thereby held firmly between base 206 and the shoulder 214.

Always visible in FIG. 8, the handle comprises a trigger 203 disposed in a body of the handle and a mechanism 204 for pressing the pushbutton 206, said mechanism being connected to the trigger 203. The mechanism in this case is a mechanism turning about an axis 220 and provided with a finger pressing on the button 6 when the trigger is operated.

In order to prevent ill-timed pressing of the pushbutton, the handle comprises a slider 210 which is moved between a locking position and an unlocking position of the trigger.

Still according to FIG. 8, the base is supported by a shaft 217 mounted in sliding fashion relative to the body of the handle 201. The shaft 217 is provided with means 208 of stopping the shaft according to a plurality of positions, such that the handle is adapted to housings of different heights. The stopping means 208 comprise a plate **208*a* provided with a pin 208*c* which is inserted in holes 217*a* in the shaft 217 and a return spring 208*b*** of the plate.

The shaft is received in a sleeve 209 which bears against the side of the vessel 1, increasing the stability of the assembly of the handle on the aerosol actuator. The sleeve is connected in its upper portion to the annular retaining means 215 and in its lower portion to the handle body 201 by means of a crosspiece 201*a*.

Figure 9:
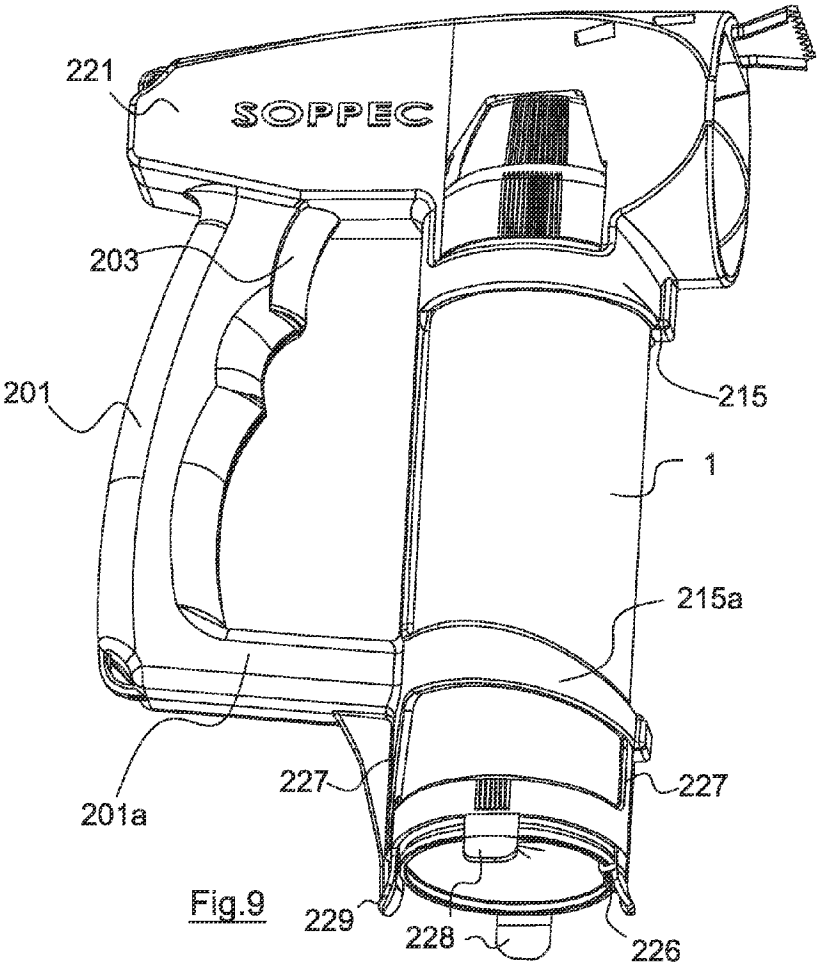
in FIG. 9: a perspective view of a variant of the open handle in FIG. 8 mounted on an aerosol actuator.

In a simplified version, such as the variant in FIG. 9, for example, the base can be replaced by a hook 226 hooking into a hollow beneath the housing.

In this example, the mobile shaft is replaced by a fixed device extending the handle body 201 from the side opposite the diffuser, in other words, a side opposite the operating portion of the button.

An embodiment of this kind is adapted, for example, when the handle is used for housings all of the same height.

According to this example, the handle comprises a second ring 215*a* for retaining and centering the vessel attached to the handle body by the crosspiece 201*a*.

This second retaining ring supports retaining legs 227 in this case extending opposite the handle body 201.

The retaining legs are connected by an annular spring component disposed about the lower end of the vessel.

The annular spring component serves to disengage the hook 226 from the vessel 1.

To achieve this, the spring component is oval in shape with a greater diameter than the diameter of the vessel at the level of the disengagement tabs 228 of the hook 226.

Disengagement is achieved by twisting the spring component by pressing on the annular spring component with the fingers at the level of the tabs 228, which pushes the hook 226 back towards the front and releases it from beneath the vessel.

The hook 226 is opposite a support tongue 229 improving retention of the vessel, itself being capable of having a second hook.

This variant is less expensive since it has fewer parts to assemble, but it is only adapted to a single housing size.

The invention is not limited to the example shown and covers any variant falling within the scope of the claims. In particular, the reference means 13, 14 represented beneath the product output nozzle may be positioned differently and, for example, may be displaced on one side between the ridges 30 and 31. Moreover, it is also possible, while remaining within the framework of the invention, to combine a hook, such as the hook 226, with a shaft, such as the shaft 217.

The invention claimed is:

1. A diffuser cap for an aerosol actuator to be mounted on a vessel comprising a valve mounted on a dome of said vessel, the diffuser cap comprising:

a pushbutton for operating the valve cooperating with an outlet tube from the valve, the pushbutton of the diffuser cap comprising a channel and an aerosol diffusion outlet;

a base configured to snap onto a crimped region of said dome and comprising an annular groove;

a protective unit for the pushbutton forming an overcap surrounding the pushbutton and comprising an annular skirt, the pushbutton and the protective unit of the pushbutton being mounted in a rotary manner on the base;

a disabling device for preventing operation of the pushbutton operated by a relative movement of the protective unit in relation to the base; and wherein the protective unit and the base comprise first and second snap-on configured to cooperate to hook the protective unit onto the base, the first snap-on provided on the base and supported by an inside wall of the annular groove limited by the inside wall and by an outside wall, the second snap-on realized on an inner face of the annular skirt of the protective unit and inserted between the inside wall and the outside wall of the annular groove of the base, the annular groove having a width configured to resist unsnapping of the annular skirt by pulling.

2. The diffuser cap of claim 1, wherein the protective unit and the pushbutton are provided as a single part, the pushbutton is connected to the protective unit by a flexible tongue.

3. The diffuser cap of claim 1, wherein the disabling device is activated and deactivated by rotating the protective unit.

4. The diffuser cap of claim 3, wherein the disabling device comprises a shoulder and a finger configured to bear against the shoulder in a locking position of the pushbutton.

5. The diffuser cap of claim 3, wherein the protective unit and the base comprise a stopper for stopping rotation of the protective unit by defining a locking position and a release position of the pushbutton allowing the valve to be operated by the pushbutton, the protective unit and the base comprising reference indicators to allow the locking or release position of the pushbutton to be viewed.

6. The diffuser cap of claim 3, wherein the protective unit and the base comprise a ratchet device suitable for providing a friction point and an auditory signal during movement between a locking position and a release position of the pushbutton.

7. The diffuser cap of claim 1, wherein the overcap is provided with a flush-fitting profile in a drip molding in the base.

8. The diffuser cap of claim 1, wherein the channel opens out into a receiving chamber of a removable nozzle provided with the aerosol diffusion outlet and a positioning lug configured to engage the pushbutton.

9. An aerosol actuator comprising the vessel; the valve fitted to the vessel utilizing the dome; the diffuser cap of claim 1; and wherein the base is rotatably mounted on the vessel and snaps onto a crimped region of the dome on the vessel to cover an upper portion of a housing.

10. An aerosol actuator and removable handle assembly comprising the aerosol actuator of claim 9 and a handle; and wherein the handle comprises a trigger, a pressing mechanism on the pushbutton linked to the trigger and an overcap concealing at least one operating portion of the pushbutton, said overcap of the handle comprising indentations configured such that the disabling device activated and deactivated by rotating the protective unit remains accessible.

11. The aerosol actuator and removable handle assembly of claim 10, wherein said overcap of the handle comprises a cutout configured to leave a diffusion nozzle visible, the cutout being surrounded by a skirt guarding against spray coming from the diffusion nozzle.

12. The aerosol actuator and removable handle assembly of claim 10, wherein the handle comprises a ring encircling and retaining the vessel.

13. The aerosol actuator and removable handle assembly of claim 10, wherein the handle comprises a hook fixed beneath the vessel opposite the diffuser cap.

14. The aerosol actuator and removable handle assembly of claim 13, wherein the hook is supported by a shaft mounted in a sliding manner relative to a body of the handle.

15. The aerosol actuator and removable handle assembly of claim 14, wherein the handle is provided with a stopper for stopping the shaft at a plurality of positions to accommodate housings of different heights.

16. The aerosol actuator and removable handle assembly of claim 14, wherein the shaft is received in a sleeve bearing against a side of the vessel.

17. The aerosol actuator and removable handle assembly of claim 13, wherein the hook is provided in a form of a base.

18. The aerosol actuator and removable handle assembly of claim 13, wherein the hook connects to a hollow beneath the housing.

19. The aerosol actuator and removable handle assembly of claim 12, wherein the handle comprises a hook fixed beneath the vessel opposite the diffuser cap and connecting to a hollow beneath the housing and the handle comprises a fixed device extending the handle from a side opposite the operating portion of the button, the fixed device comprises a second ring for retaining and centering the vessel, retaining legs connected by an annular spring component disposed about a lower end of the vessel and supporting disengagement tabs for disengaging the hook.

20. The aerosol actuator and removable handle assembly of claim 10, wherein the handle comprises a component for hooking a scraper tool extending from an upper face of said overcap of the handle.

21. The aerosol actuator and removable handle assembly of claim 10, wherein the handle comprises a trigger locking clip.

* * * * *